US007370700B2

(12) United States Patent
Hurst et al.

(10) Patent No.: US 7,370,700 B2
(45) Date of Patent: May 13, 2008

(54) MULTIPLE ENTRANCE SHUNT

(75) Inventors: Gary D. Hurst, Hastings, OK (US); David R. Mandeville, Missouri City, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 0 days.

(21) Appl. No.: 11/674,729

(22) Filed: Feb. 14, 2007

(65) Prior Publication Data

US 2007/0131421 A1 Jun. 14, 2007

Related U.S. Application Data

(63) Continuation of application No. 10/372,534, filed on Feb. 21, 2003, now Pat. No. 7,207,383.

(60) Provisional application No. 60/359,568, filed on Feb. 25, 2002.

(51) Int. Cl.
*E21B 17/00* (2006.01)

(52) U.S. Cl. ..... 166/242.3; 166/242.1; 166/51; 138/116

(58) Field of Classification Search ..... 166/51, 166/242.3, 242.1, 56, 380; 138/116, 111
See application file for complete search history.

(56) References Cited

U.S. PATENT DOCUMENTS

| | | | | |
|---|---|---|---|---|
| 4,865,138 | A * | 9/1989 | Swietlik | 175/325.7 |
| 5,497,809 | A * | 3/1996 | Wolf | 138/113 |
| 6,032,748 | A * | 3/2000 | DeBray et al. | 175/325.7 |
| 6,634,388 | B1 * | 10/2003 | Taylor et al. | 138/114 |
| 2002/0125006 | A1 * | 9/2002 | Hailey et al. | 166/278 |
| 2002/0174984 | A1 * | 11/2002 | Jones | 166/278 |
| 2002/0189809 | A1 * | 12/2002 | Nguyen et al. | 166/278 |
| 2003/0183386 | A1 * | 10/2003 | McGregor et al. | 166/278 |
| 2007/0144782 | A1 * | 6/2007 | Krueger et al. | 175/40 |

* cited by examiner

*Primary Examiner*—Jennifer H. Gay
*Assistant Examiner*—Daniel P Stephenson
(74) *Attorney, Agent, or Firm*—Trop, Pruner & Hu, P.C.; Bryan P. Galloway

(57) ABSTRACT

Multiple pathways are provided by which fluid can enter one or more alternate pathway conduits. Entrance tubes can be arranged such that their spacing prevents all of them from being simultaneously obstructed, covered, or otherwise blocked.

15 Claims, 1 Drawing Sheet

MULTIPLE ENTRANCE SHUNT

This application is a continuation of U.S. patent application Ser. No. 10/372,534, entitled "MULTIPLE ENTRANCE SHUNT," filed on Feb. 21, 2003, which claims the benefit under 35 U.S.C. § 119(e) to U.S. Provisional Application 60/359,568, entitled "MULTIPLE ENTRANCE SHUNT," filed Feb. 25, 2002. Each of these applications is hereby incorporated by reference in its entirety.

BACKGROUND

The invention generally relates to shunt tubes used in subsurface well completions, and particularly to shunt tubes having multiple entrances.

Conduits providing alternate or secondary pathways for fluid flow are commonly used in well completions. The alternate pathways allow fluid to flow past and emerge beyond a blockage in a primary passageway. In prior art embodiments, the single entrance to an alternate pathway conduit could be covered, blocked, or otherwise become inaccessible to the fluid, thereby preventing the alternate pathway conduit from performing its intended function. Such blockage could occur, for example, when the conduit happened to be positioned on the bottom wall of a horizontal bore. Alternatively, if low viscosity fluids are used in an alpha beta wave pack, or should pumping fail, the conduit may become blocked. Therefore, there is a continuing need for improved entrance mechanisms to provide more reliable access to the alternate pathway conduits.

SUMMARY

In an embodiment of the invention, multiple pathways are provided by which fluid can enter one or more alternate pathway conduits. Entrance tubes can be arranged such that their spacing prevents all of them from being simultaneously obstructed, covered, or otherwise blocked.

Advantages and other features of the invention will become apparent from the following description, drawings, and claims.

DETAILED DESCRIPTION

Figure 1:
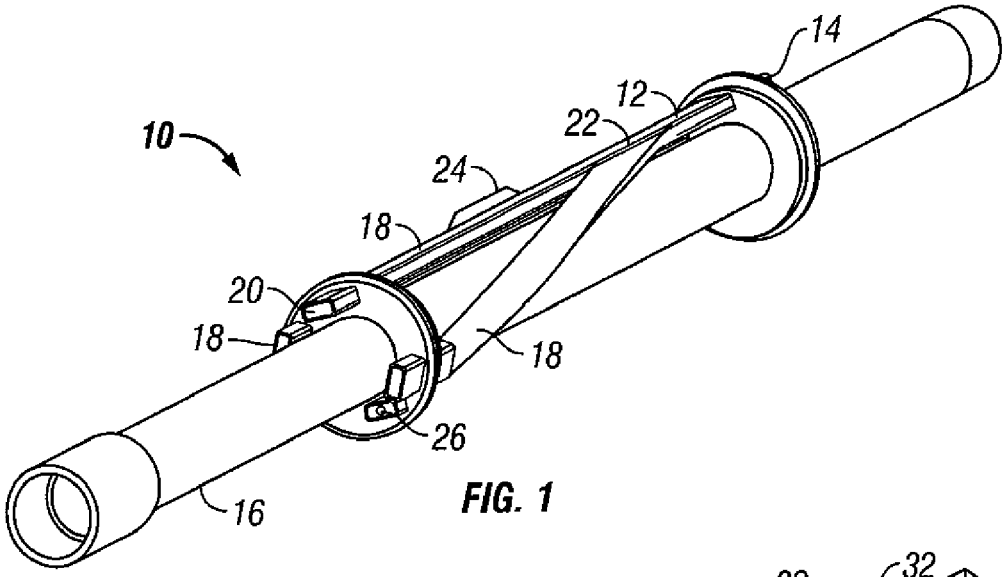
FIG. 1 is a schematic diagram of a portion of a completion assembly constructed in accordance with an embodiment of the invention.

FIG. 1 shows a portion of a completion assembly 10 used in a well. A shunt tube 12 having a central passageway 14 is mounted on base pipe 16. Only one shunt tube 12 is shown, but there may be more than one. Base pipe 16 may be slotted or perforated base pipe or production tubing. Entrance tubes 18 are also mounted on base pipe 16. Entrance tubes 18 are azimuthally spaced around the circumference of base pipe 16 and connect at their lower ends to shunt tube 12. Those connections could be made using jumper tubes or other connectors known in the art. Each entrance tube 18 has a passageway 20 in fluid communication with central passageway 14 to accommodate fluid flow through entrance tubes 18 and shunt tube 12.

In the embodiment of FIG. 1, entrance tubes 18 are joined at a manifold 22. Entrance tubes 18 may, however, join shunt tube 12 in various places along the length of shunt tube 12, without relation to the junction of shunt tube 12 and other entrance tubes 18. Entrance tubes 18 may also join to more than one shunt tube 12. Entrance tubes 18 may have similar flow capacity to shunt tube 12, or in an alternative embodiment, entrance tubes 18 may have a smaller flow capacity than shunt tube 12. The flow capacities and angle of intersection of entrance tubes 18 with shunt tube 12 is chosen so as to prevent blockage from occurring within entrance tubes 18 or shunt tube 12. That may be a concern, for example, should pumping be halted before a desired operation is completed.

FIG. 1 shows centralizers 24 radially extending from base pipe 16. Centralizers 24 are azimuthally spaced around the circumference of base pipe 16 and serve to keep base pipe 16 approximately centered in the wellbore. Shunt tubes 12 and entrance tubes 18 can be run between centralizers 24 and inside or outside a sand screen. (not shown).

Because shunt tube 12 is an alternate pathway conduit, used to convey fluid past a blockage, it may be desirable to restrict fluid from entering entrance tubes 18 until shunt tube 12 is needed. That could be done by placing restriction members 26 such as valves or rupture discs across the openings of entrance tubes 18. By using rupture discs, for example, flow into entrance tubes 18, and therefore shunt tube 12, would be prevented under normal operating pressures. However, if a blockage (bridging) occurred, pressure in the annular region could be increased until one or more discs burst, allowing fluid to pass.

Figure 2:
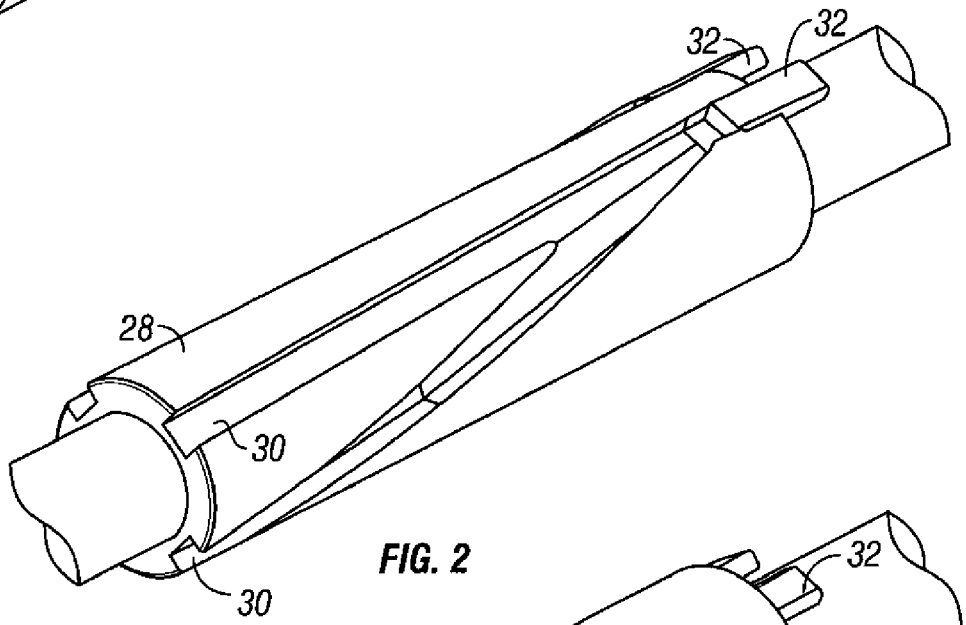
FIG. 2 is a partially cutaway schematic diagram of an alternative embodiment of a completion assembly constructed in accordance with an embodiment of the invention.
Figure 3:
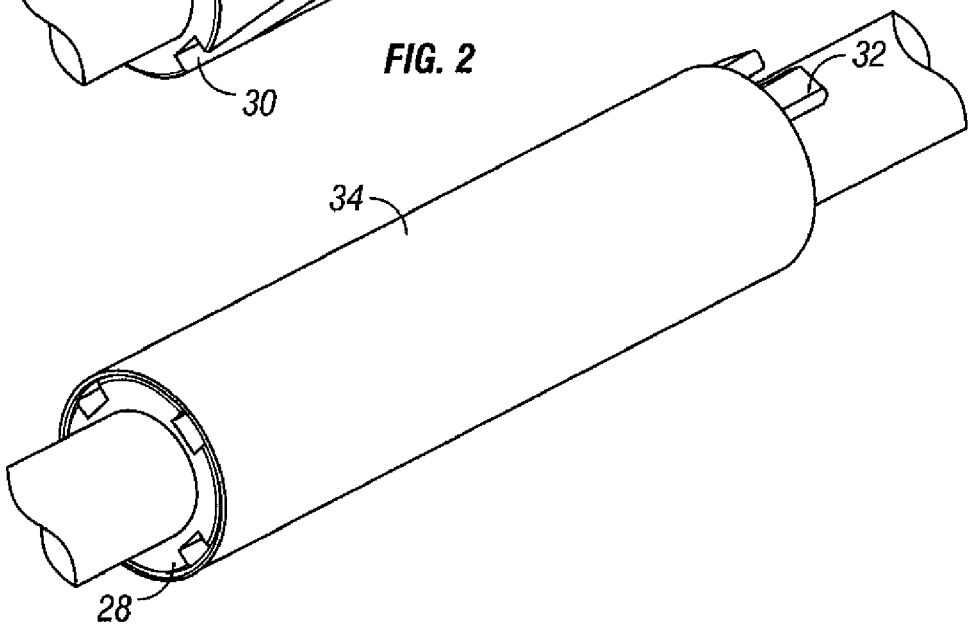
FIG. 3 is a perspective view of the completion assembly of FIG. 2.

FIGS. 2 and 3 shows an alternative embodiment of the invention. FIG. 2 shows a body 28 having channels 30. Channels 30 can be milled or formed using other conventional methods. Channels 30 form pathways for fluid flow and essentially serve the functions of entrance tubes 18. Channels 30 merge to direct their flow into one or more outlets 32. There may be any number of channels 30, the openings of which are azimuthally spaced. A cover 34 (FIG. 3) is mounted to body 28 to confine the fluid entering a particular channel 30 to travel through that channel 30 until it reaches an outlet 32. Outlets 32 join to sand screen assemblies (not shown) using jumper tubes or other known connectors.

In the embodiment shown in FIGS. 2 and 3, there are four channels 30 (though one channel 30 is obscured from view). Because there are two outlets in this instance, those four channels 30 are divided into pairs. The two channels 30 forming one particular pair merge to direct their fluid to one of the outlets 32. The other pair similarly merges to direct its output to the other outlet 32. Channels 30 can be merged by groups according to the number of outlets 32 available in any particular embodiment. Restriction members 26 can be placed in channels 30 to control access by the fluid until some operational condition is met. In the embodiment of FIGS. 2 and 3, base pipe 16 is preferably not slotted or perforated.

In operation, a fluid such as a gravel slurry or fracturing fluid is pumped into an annular region between a production zone of the well and base pipe 16. Often the fluid is initially pumped through a work string down to a crossover mechanism which diverts the flow into the annular region some distance below the well surface. In any case, when the fluid encounters entrance tubes 18, it flows into entrance tubes 18 and travels through passageway 20. Because entrance tubes 18 are azimuthally arranged, there is always at least one open fluid path through entrance tubes 18 into central passageway 14 of shunt tube 12. That insures the fluid can pass into shunt tube 12.

The operation of the alternative embodiment is similar. The fluid is pumped into the annulus. When bridging occurs, the fluid backs up and the pressure increases. The fluid finds the openings of channels 30 and, in the absence of restrictor devices, flows into channels 30 and into shunt tubes 12. In those embodiments employing restrictor members 26, the fluid may be restricted from passing into the relevant passageway until the restriction member 26 therein is defeated.

Although only a few example embodiments of the present invention are described in detail above, those skilled in the art will readily appreciate that many modifications are possible in the example embodiments without materially departing from the novel teachings and advantages of this invention. Accordingly, all such modifications are intended to be included within the scope of this invention as defined in the following claims. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A completion assembly for use in a well, comprising:

a base pipe;

a body mounted to the base pipe, the body having a plurality of channels that are each open substantially along the entire length of the channel, the channels having azimuthally spaced entrances around the base pipe, and at least two of the channels to merge to form a consolidated channel in the body; and an outlet in fluid communication with the channels, the outlet adapted to form a connection with a sand screen assembly.

2. The completion assembly of claim 1, further comprising restriction members in at least some of the channels.

3. The completion assembly of claim 2, wherein at least one of the restriction members comprises blocks communication with one of the channels until a pressure exerted on the restriction member exceeds a predetermined threshold indicative of blockage of a pathway used in connection with a well completion operation.

4. The completion assembly of claim 1, wherein the outlet is part of a plurality of outlets and in which only certain channels fluidly communicate with certain outlets.

5. The completion assembly of claim 4, wherein the flow capacities of the channels and angles of intersection between the channels are chosen to prevent blockage therein.

6. The completion assembly of claim 1, further comprising a cover mounted to the body to confine fluid within the channels.

7. The completion assembly of claim 1, wherein the channels comprise four channels and the outlet is one of two outlets, one pair of channels being in fluid communication with one of the outlets, and the other pair of channels being in fluid communication with the other outlet.

8. The completion assembly of claim 1, further comprising:

a connector to connect the outlet to the sand screen assembly.

9. The completion assembly of claim 8, wherein the connector comprises a jumper tube.

10. A method comprising:

providing a base pipe;

providing a plurality of channels on a body that is mounted to the base pipe, each channel being open substantially along the entire length of the channel, and the channels having azimuthally spaced entrances around the base pipe;

communicating a slurry flow through at least one of the channels; and providing a connection between said at least one of the channels and a sand screen assembly.

11. The method of claim 10, further comprising:

providing restriction members in at least some of the channels.

12. The method of claim 10, wherein the act of communicating occurs in response to a pressure in an alternative pathway exceeding a pressure threshold during communication of a slurry flow trough the alternative pathway.

13. The method of claim 10, wherein the act of providing the connection comprises:

connecting a jumper tube between an outlet that is in communication with said at least one of the channels and the sand screen assembly.

14. A method comprising:

providing a base pipe;

providing a plurality of channels on a body that is mounted to the base pipe, each channel being open substantially along the entire length of the channel, and the channels having azimuthally spaced entrances around the base pipe;

communicating a slurry flow through at least one of the channels; and merging at least two of the channels to form a consolidated channel in the body.

15. A method comprising:

providing a base pipe;

providing a plurality of channels on a body that is mounted to the base pipe, each channel being open substantially along the entire length of the channel, and the channels having azimuthally spaced entrances around the base pipe;

communicating a slurry flow through at least one of the channels; and confining fluid within the channels, comprising mounting a cover over the body.

* * * * *